US011577377B2

(12) United States Patent
Conaway

(10) Patent No.: US 11,577,377 B2
(45) Date of Patent: Feb. 14, 2023

(54) MOBILE INVERTED DRILL PRESS

(71) Applicant: Corey Curtis Conaway, Clearfield, PA (US)

(72) Inventor: Corey Curtis Conaway, Clearfield, PA (US)

( * ) Notice: Subject to any disclaimer, the term of this patent is extended or adjusted under 35 U.S.C. 154(b) by 0 days.

(21) Appl. No.: 17/825,865

(22) Filed: May 26, 2022

(65) Prior Publication Data

US 2022/0379459 A1 Dec. 1, 2022

Related U.S. Application Data

(63) Continuation of application No. 17/336,087, filed on Jun. 1, 2021.

(51) Int. Cl.
*B25H 1/00* (2006.01)

(52) U.S. Cl.
CPC ..... *B25H 1/0035* (2013.01)

(58) Field of Classification Search
CPC ..... Y10T 408/6786; B25H 1/0035; B25H 1/0021; B25H 1/0078; B25H 1/10; B25G 3/38; B25G 1/04; B25F 5/021; B25F 5/024; B23B 47/26; B23B 47/28
See application file for complete search history.

(56) References Cited

U.S. PATENT DOCUMENTS

| | | | | |
|---|---|---|---|---|
| 2,879,677 A * | 3/1959 | Baublitz | ..... | B25H 1/0035 408/136 |
| 4,736,804 A * | 4/1988 | Geibel | ..... | B25H 1/0035 408/136 |
| 6,095,724 A * | 8/2000 | Hurt | ..... | B25H 1/0035 408/136 |
| 2004/0240952 A1 | 12/2004 | Perry | | |
| 2005/0214085 A1 * | 9/2005 | Owens | ..... | B25H 1/0057 408/136 |

FOREIGN PATENT DOCUMENTS

DE 20009818 U1 * 11/2000 ..... A61B 17/3417

* cited by examiner

*Primary Examiner* — Tyrone V Hall, Jr.
(74) *Attorney, Agent, or Firm* — Michael L. Greenberg, Esq.; Greenberg & Liberman, LLC

(57) ABSTRACT

A vertical inverted drill press apparatus configured to extend a drill about a vertical support having a top portion and a bottom portion. The top portion is configured to telescope out and away from the bottom portion when manipulated via a lever. The lever pivots about a pivot point. The lever amounts to a handle disposed in communication with an actuator which manipulates a swing arm. The swing arm is connected to the telescoping top portion. When the handle is pulled down, the top portion is forced upwards in a straight line along the primary axis of the body. A drill mount is configured to secure a drill in an inverted, drill-bit-up orientation to facilitate the drilling of holes in ceilings and similar locations.

11 Claims, 3 Drawing Sheets

MOBILE INVERTED DRILL PRESS

CONTINUITY

This application is a continuation non-provisional application of non-provisional patent application Ser. No. 17/336,087, filed on Jun. 1, 2021, and priority is claimed thereto.

FIELD OF THE PRESENT INVENTION

The present invention relates to construction equipment, and more specifically relates to a tool accessory configured to stabilize and elevate a drill for use on ceilings, roofs, rafters, and similar locations conventionally accessed from below.

BACKGROUND OF THE PRESENT INVENTION

It is common to use a drill in an inverted position in order to drill holes from the bottom of a stationary object. For example, a drill is used in an inverted position to provide drainage holes to a flooded roof, to affix brackets to rafters, or to drill pilot holes in structural supports.

Unfortunately, these activities require drilling multiple holes in multiple locations, each of which is generally far above the head of the operator of the drill. As such, to drill these holes, the user is generally required to either have a scaffold and/or use a ladder. With the use of a ladder, this quickly becomes a very cumbersome activity as the user must first move the ladder to a first desired location for a hole, ascend the ladder, drill the hole, descend the ladder, and then move the ladder to a second location. This process must be repeated until the requisite number of holes have been drilled. If there were a way to elevate the drill and safely operate it remotely while the user remains on the ground, the process of drilling many holes quickly with a drill in an inverted position would be much easier and faster, and no ladder would be required.

While various drill accessories are presently available on the market, these devices are limited in scope, and do not offer adequate height adjustment mechanisms, nor are they usually well stabilized during use in an inverted position away from the hands of the user. Instead, these devices are configured to merely protect the user from injury, or amount to a modified handle for different uses.

Thus, there is a need for a new form of drill accessory configured to facilitate the inverted and elevated use of a conventional, off-the-shelf drill while exhibiting a compact and foldable design. Such an apparatus is preferably equipped with a telescoping stabilizing component configured to contact the floor or ground. Likewise, such an apparatus preferably employs a pivoting swing arm configured to facilitate the controlled extension and contraction of the drill into and out of a target upon drilling a hole. A comfortable horizontal handle is preferably included, which functions as a lever to facilitate the raising and lowering of the drill in a vertical orientation.

Some similar devices have been found in the art, however none of these devices function in the same manner as that of the present invention, nor do they include a hard switch to facilitate safe activation and deactivation of the drill remotely. For example, Klaus (DE20009819U1) teaches a device for lifting a tool, such as a drilling machine, via an upright vertical body. While Klaus teaches a similar mechanism by which the drilling machine may raise and lower as that of the present invention, unlike the present invention, Klaus does not teach the integration of a switch, and has a fundamentally different pivoting mechanism by which a top portion of the present invention is raised via a swing arm. The top portion of the present invention telescopes outwards, extending the overall height of the apparatus, and raising the drill and drill bit into the target in a vertical orientation.

Likewise, Perry teaches a device for drilling holes in a ceiling in US2004240952(A1) which is similar in scope to the present invention. However, Perry fails to teach the implementation of a switch, unlike the present invention. Additionally, the invention taught by Perry employs wheels to facilitate movement of the device. This makes the device more cumbersome than the present invention. Additionally, an actuator taught by Perry is disposed at a bottom of the device, near the floor, and is therefore not as easy to use as the comfortable, hand-height handle of the present invention. Similarly, the apparatus taught by Perry is not adjustable in its overall height, unlike the present invention.

Cousineau et al. teaches an Extendable Arm for Power and Impact Tools in U.S. application No. 19920960492 which appears to function similarly to that of the present invention. However, Cousineau et al. fails to teach the use of swing arms, a switch, and telescoping portions of the device, unlike the present invention. Additionally, the invention taught by Cousineau et al. is configured to be manipulated by the foot of the user. This is unlike the present invention, which is comfortably manipulated in height by the hand of the user.

SUMMARY OF THE PRESENT INVENTION

The present invention is a telescoping drill accessory configured to facilitate remote operation of a drill safely in an inverted orientation. The present invention employs a pivot arm which is configured to enable controlled manipulation of the extension and retraction of the drill towards and away from a target. The apparatus of the present invention is configured to enable the user to perform high-speed drilling of holes while remaining able to move location around a room to change where the subsequent hole is to be drilled. This is advantageous compared to the traditional method of drilling holes from beneath an object (such as a roof), which requires climbing up a ladder, drilling a hole from the bottom-up, descending the ladder, moving the ladder to a new location, and repeating the process as needed until all required holes are drilled. Instead, a user of the present invention may simply move about on the floor, without the use of any ladder, and securely, safely, and stably drill holes as needed in any location.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
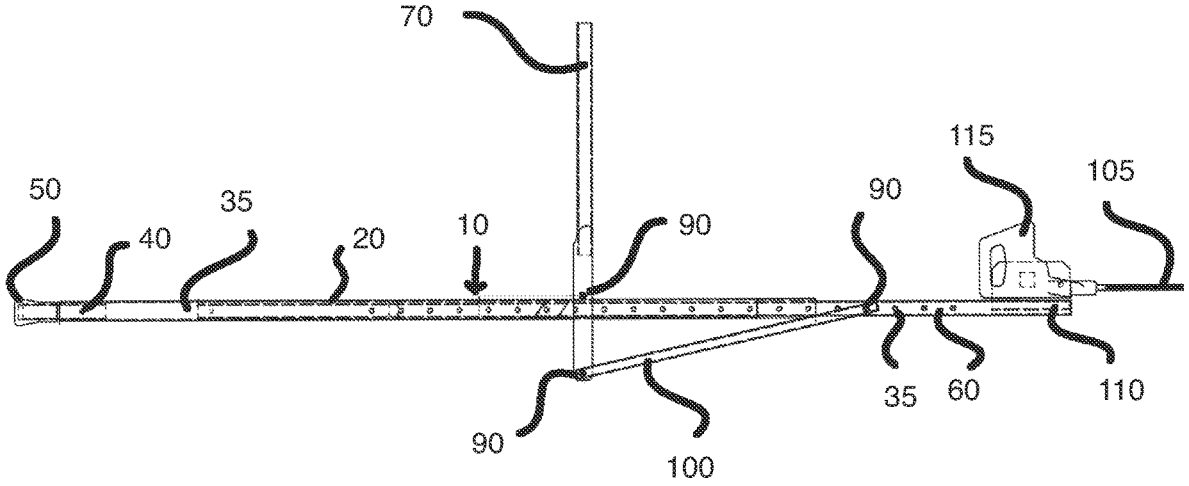
FIG. 1 exhibits the present invention from the front and side.
Figure 2:
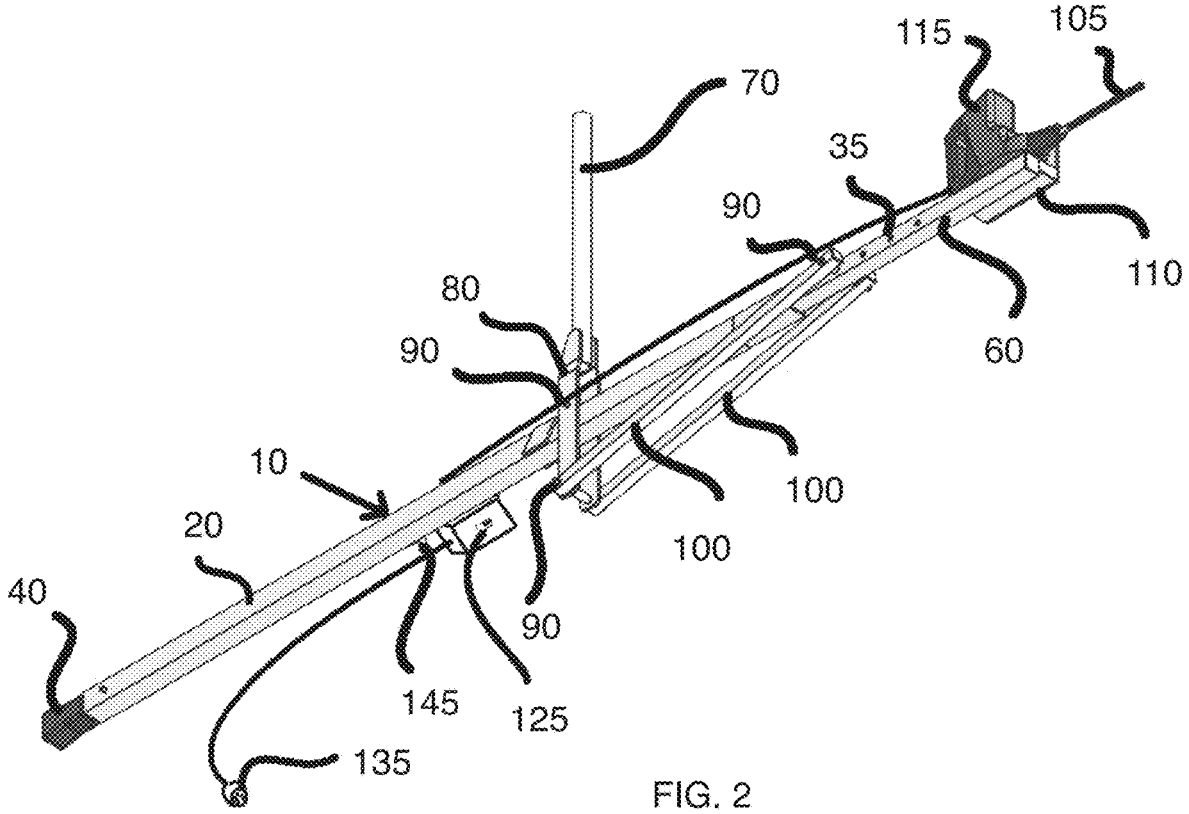
FIG. 2 shows an isometric view of the present invention affixed to a conventional drill as seen from the front, with the apparatus securely connected to the drill.

The present invention is a drill accessory configured to make it easier and faster to use a drill in a vertically inverted orientation while effectively extending the handle of the drill so as to facilitate use of the drill remotely. The present invention is a device equipped with a body (10) having a bottom portion (20) and a top portion (30). The bottom portion (20) exhibits a support strut (40) which is configured to contact the floor or ground to stabilize the present invention during use. A rubber cap (50) is preferably present on the bottom of the support strut (40) as shown in FIG. 1, which helps the support strut (40) maintain stabilizing contact with the floor during use of the apparatus.

A telescoping extension (60) is disposed on the top portion (30) of the apparatus which extends out and away from the support strut (40) of the bottom portion (20). A handle (70) is disposed perpendicular to the body (10) of the present invention as shown in FIG. 1. The handle (70) is connected to an actuator (80) at or near its junction to the support strut (40) of the body (10) at a pivot point (90). The actuator (80) extends beyond the primary plane of the body (10), as well as beyond the pivot point (90) and terminates at a junction of the actuator (80) to a swing arm (100) (or arms). The swing arm (100) then extends up to, and connects to, the telescoping extension (60) at an angle at another pivot point (90). The actuator (80) and handle (70) function as a crank arm, pivotally connected to the body (10) to facilitate the further extension of the telescoping extension (60) of the present invention. The swing arm (100) connects to the telescoping extension (60) at one of at least five locations via a screw or bolt. The multiple connection locations for the swing arm (100) on the telescoping extension (60) enables the operator to alter the overall initial height of the body (10) of the apparatus to accommodate ceilings, roofs, rafters, or other high locations of differing heights with ease. The telescoping extension (60) of the top portion (30) is preferably adjustable in position via a conventional push-button locking mechanism (35).

The telescoping extension (60) is equipped with a mount (110) which is configured to facilitate the connection of a drill (115) to the apparatus. The mount (110) is oriented such that the drill bit (105) of the drill (115) maintains the same axis as that of the apparatus itself, and therefore remains parallel to the telescoping extension (60) and support strut (40) of the present invention when affixed to the mount (110). Preferably at least two screws are employed to affix the mount (110) to the drill in order to ensure that the drill remains firmly affixed to the present invention, and does not shift in angle or orientation during use. A switch (125) is preferably disposed within a switch box, and is configured to function as an inline switch. As such, the switch box is preferably equipped with a female plug to which the male plug of the drill is connected. A plug (135) then connects the switch to the power supply. The switch (125) is preferably a GFCI switch. The switch (125) and accompanying switch box is preferably affixed to a switch mount (145) of the body (10).

Figure 3:
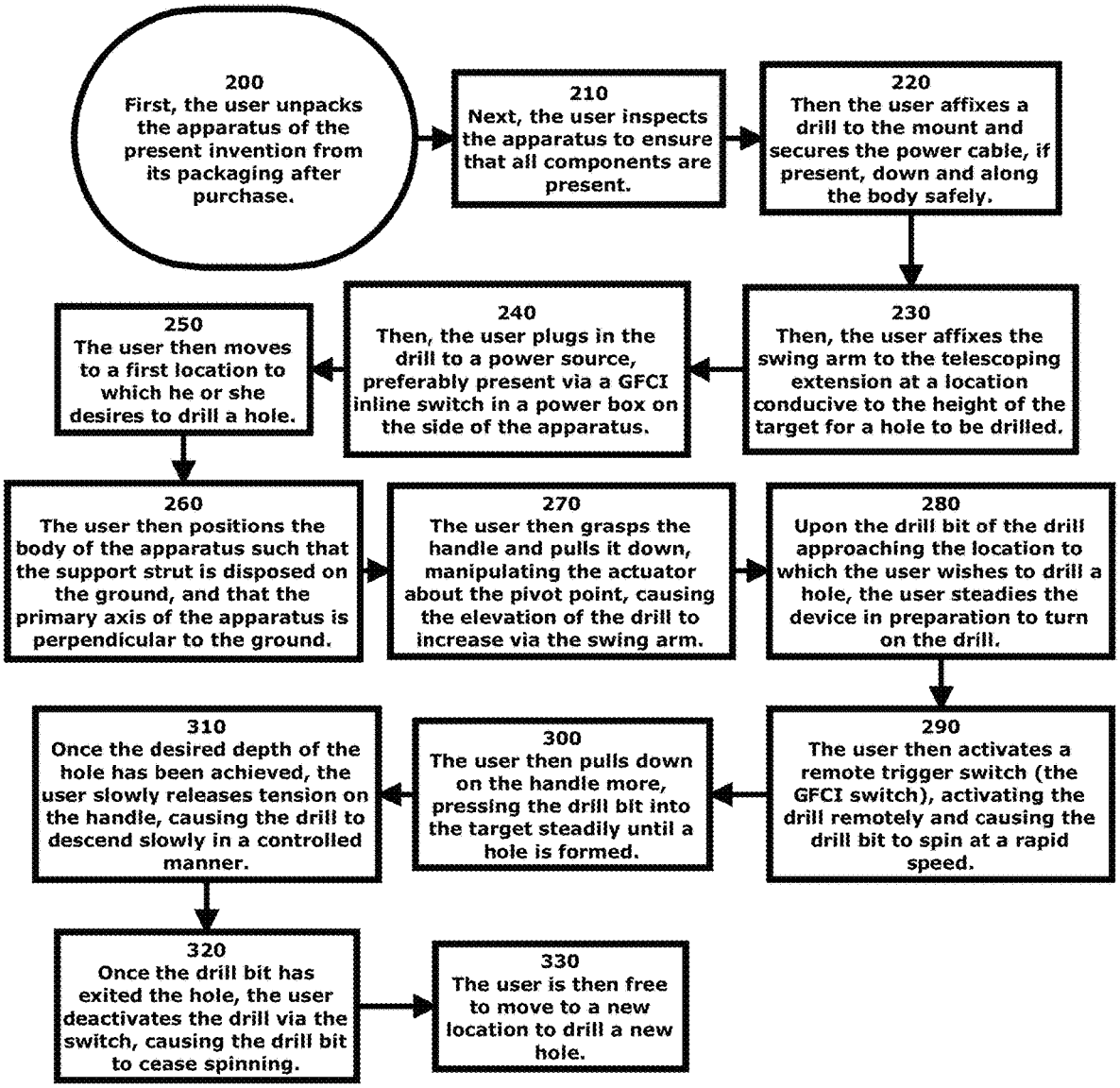
FIG. 3 exhibits a flow chart detailing the process of use of the present invention.

The process of use of the apparatus of the present invention by a user, as seen in FIG. 3, is preferably as follows:

1. First, the user unpacks the apparatus of the present invention from its packaging after purchase. (200)
2. Next, the user inspects the apparatus to ensure that all components are present. (210)
3. Then the user affixes a drill to the mount and secures the power cable, if present, down and along the body safely. (220)
4. Then, the user affixes the swing arm to the telescoping extension at a location conducive to the height of the target for a hole to be drilled. (230)
5. Then, the user plugs in the drill to a power source, preferably present via a GFCI inline switch in a power box on the side of the apparatus. (240)
6. The user then moves to a first location to which he or she desires to drill a hole. (250)
7. The user then positions the body of the apparatus such that the support strut is disposed on the ground, and that the primary axis of the apparatus is perpendicular to the ground. (260)
8. The user then grasps the handle and pulls it down, manipulating the actuator about the pivot point, causing the elevation of the drill to increase via the swing arm. (270)
9. Upon the drill bit of the drill approaching the location to which the user wishes to drill a hole, the user steadies the device in preparation to turn on the drill. (280)
10. The user then activates a remote trigger switch (the GFCI switch), activating the drill remotely and causing the drill bit to spin at a rapid speed. (290)
11. The user then pulls down on the handle more, pressing the drill bit into the target steadily until a hole is formed. (300)
12. Once the desired depth of the hole has been achieved, the user slowly releases tension on the handle, causing the drill to descend slowly in a controlled manner. (310)
13. Once the drill bit has exited the hole, the user deactivates the drill via the switch, causing the drill bit to cease spinning. (320)
14. The user is then free to move to a new location to drill a new hole. (330)

In preferred embodiments of the present invention, it should be noted that the trigger of the drill is preferably locked into the 'on' position such that, when power is supplied to the drill, it is automatically activated. The trigger of the drill may be locked into this position via a locking feature of the drill itself, or may be manually restrained in the 'on' position via a zip tie or similar restraint. Further, it should be noted that the apparatus of the present invention is designed to function with an AC powered drill, rather than a battery powered drill as the switch (125) is configured to toggle the drill on and off by disconnecting the power supply directly rather than manipulating the trigger of the drill itself. However, it is envisioned that, in alternate embodiments of the present invention, a different form of remote-based switch may be configured to manipulate the trigger, removing the need for the integrated GFCI switch of the apparatus. At present, the apparatus is solely configured for use with AC powered drills.

It should be understood that some embodiments of the present invention may exhibit different shapes and sizes of support strut (40). For example, a smaller embodiment may be manufactured which is tailored for use on ceilings present in close quarters, such as a closet. Additionally, it should be understood that the apparatus of the present invention may be made available in an assortment of colors, textures, and patterns, and may be equipped with logos as desired. The body (10) of the present invention is preferably fashioned of a high-quality metallic alloy which is durable and comfortable for extended use. Further, it should be noted that the body (10) and the support strut (40) are preferably beveled and/or rounded to prevent sharp edges, preventing injury of the user during use of the present invention.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A mobile inverted vertical drill press comprising:

a body, said body having a bottom portion and top portion;

a support strut, said support strut disposed on a first end of said bottom portion;

a rubber cap, said rubber cap present on said support strut;

a telescoping extension, said telescoping extension disposed on a first end of said top portion, disposed opposite of said support strut;

wherein said telescoping extension is configured to extend out of and away from said first end of said top portion while remaining in-line with said top portion;

wherein said telescoping portion is four-sided, exhibiting a first square shape having a first dimension;

wherein said top portion is four-sided, exhibiting a second square shape having a second dimension;

wherein said second dimension is greater than said first dimension such that said telescoping portion may slide within said top portion;

wherein said telescoping extension is adjustable via a push-button locking mechanism;

an actuator, said actuator disposed perpendicular to said body, in communication with a handle, a first pivot point, and a swing arm;

wherein said handle is disposed near a midpoint of said body;

wherein said first pivot point joins said actuator to said body;

wherein said actuator extends beyond a primary plane of said body;

wherein said swing arm is attached to said actuator via a second pivot point;

wherein said swing arm is affixed to said telescoping extension of said top portion via a third pivot point;

a drill mount, said drill mount affixed to said top portion;

wherein said swing arm extends from said first pivot point up towards said drill mount, terminating at said second pivot point;

wherein said second pivot point is adjustable in height;

a switch, said switch housed in a switch box; and wherein said switch box is disposed in communication with said body.

2. The mobile inverted vertical drill press of claim 1, wherein said third pivot point is movable in height to vary the potential length to which said telescoping extension may extend.

3. The mobile inverted vertical drill press of claim 2, wherein a height of said support strut is adjustable.

4. The mobile inverted vertical drill press of claim 2, wherein downward pressure on said handle forces said actuator upwards, moving said telescoping extension of said top portion via said swing arm.

5. The mobile inverted vertical drill press of claim 2, wherein said telescoping extension retracts by gravity when pressure is relieved from said handle.

6. The mobile inverted vertical drill press of claim 1, wherein downward pressure on said handle forces said actuator upwards, moving said telescoping extension of said top portion via said swing arm.

7. The mobile inverted vertical drill press of claim 1, wherein a height of said support strut is adjustable via a push-button locking mechanism.

8. The mobile inverted vertical drill press of claim 1, wherein said support strut remains in the same vertical plane as said drill mount during operation.

9. The mobile inverted vertical drill press of claim 1, wherein said telescoping extension retracts by gravity when pressure is relieved from said handle.

10. The mobile inverted vertical drill press of claim 2, wherein downward pressure on said handle forces said actuator upwards, moving said telescoping extension of said top portion via said swing arm.

11. A mobile inverted vertical drill press comprising:

a body, said body having a bottom portion and top portion;

a support strut, said support strut disposed on a first end of said bottom portion;

a rubber cap, said rubber cap present on said support strut;

a telescoping extension, said telescoping extension disposed on a first end of said top portion, disposed opposite of said support strut;

wherein said top portion is square;

wherein said support strut is square;

wherein said telescoping extension is square;

wherein said telescoping extension is configured to extend out of and away from said first end of said top portion, while remaining in-line with said top portion;

an actuator, said actuator disposed perpendicular to said body, in communication with a handle, a first pivot point, and a swing arm;

wherein said handle is disposed near a midpoint of said body;

wherein said first pivot point joins said actuator to said body;

wherein said actuator extends beyond a primary plane of said body;

wherein said swing arm is attached to said actuator via a second pivot point;

wherein said swing arm is affixed to said telescoping extension of said top portion via a third pivot point;

wherein said third pivot point is movable in height to vary the potential length to which said telescoping extension may extend;

a drill mount, said drill mount affixed to said top portion;

wherein said swing arm extends from said first pivot point up towards said drill mount, terminating at said second pivot point;

wherein said second pivot point is adjustable in height;

a switch, said switch housed in a switch box;

wherein said switch box is disposed in communication with said body;

wherein downward pressure on said handle forces said actuator upwards, moving said telescoping extension of said top portion via said swing arm;

wherein a height of said support strut is adjustable;

wherein said support strut remains in the same vertical plane as said drill mount during operation; and wherein said telescoping extension retracts by gravity when pressure is relieved from said handle.

* * * * *